United States Patent [19]

Mier

[11] Patent Number: 4,861,184

[45] Date of Patent: Aug. 29, 1989

[54] CONTINUOUS FLOW CLOVERLEAF TYPE INTERCHANGE

[76] Inventor: Francisco D. Mier, 6437 Park Ridge Blvd.., San Diego, Calif. 92120

[21] Appl. No.: 131,440

[22] Filed: Dec. 11, 1987

[51] Int. Cl.[4] ..... E01C 1/00

[52] U.S. Cl. ..... 404/1

[58] Field of Search ..... 404/1; 14/1

[56] References Cited

U.S. PATENT DOCUMENTS

| | | | |
|---|---|---|---|
| 2,946,267 | 7/1960 | Cedeno | 404/1 |
| 2,949,067 | 8/1960 | Cedeno | 404/1 |
| 3,107,590 | 10/1963 | Cedeno | 404/1 |
| 4,630,961 | 12/1986 | Hellwig | 404/1 |

OTHER PUBLICATIONS

"A Policy on Geometric Design of Rural Highways" published by the American Association of State Highway Officials, 1954.

"A Policy on Geometric Design of Urban Areas", published by the American Association of State Highway Officials, 1957.

*Primary Examiner*—Jerome W. Massie

*Assistant Examiner*—Gay Ann Spahn

[57] ABSTRACT

A continuous flow cloverleaf type interchange for accommodating traffic from a plurality of road surfaces which includes a first road surface for traffic traveling in a first direction, a second road surface for traffic traveling in a direction opposite to the first direction, a third road surface for traffic traveling in a direction intersecting the first and second road surfaces, and a fourth road surface for traffic traveling in a direction opposite to the traffic traveling on the third road surface. The first and second road surfaces intersect and are disposed at a first elevation distinct relative to the third and fourth road surfaces in an area adjacent to an interchange. The first road surface left turn lane diverts traffic from the first road surface to cross the second road surface prior to the interchange and to continue traveling in a direction opposite to the second road surface in an area displaced laterally from the first road surface. At least one substantially circular cloverleaf section diverts traffic from the fourth road surface to merge with traffic from the second road surface. The first road surface left turn lane curves along the cloverleaf section to turn left without stopping and to merge from the right with traffic traveling along the fourth road surface without weaving.

13 Claims, 4 Drawing Sheets

CONTINUOUS FLOW CLOVERLEAF TYPE INTERCHANGE

BACKGROUND OF THE INVENTION

1. Field of the Invention

The present invention relates to a continuous flow cloverleaf type interchange and more particularly to a two grade level street crossing interchange enabling continuous traffic flow while eliminating weaving. The present invention permits the elimination of two circular portions of a conventional cloverleaf.

2. Description of Background Art

Vehicular traffic on conventional freeway cloverleaf interchanges require a considerable amount of land. In addition, a dangerous phenomenon of weaving occurs on the cloverleaf sections. Further, other interchange arrangements typically include traffic lanes stacked up on three or more grade levels. The cost of land acquisition to build such an interchange for an intersection is increasing. In addition, due to expansion of residential and commercial areas to areas remote from the centers of our cities, existing cloverleaf interchanges are sometimes now situated on expensive real estate.

SUMMARY OF THE INVENTION

According to the present invention, a continuous flow cloverleaf interchange is provided comprising a first road and a second road that intersect with a third road and a fourth road at two grade levels. One level is at ground elevation while another level is above ground.

The interchange is characterized by right turn lanes which are all located at a grade. Left turn lanes of two of the roads originate from the left or right side of each road and cross over to be eventually on the left side of advancing traffic before the intersection. Each left turn lane then curves through a portion of a cloverleaf section to enable traffic to merge from a right lane with intersecting traffic. Each left turn lane of the remaining two roads originates from the right side of each road and curves through a cloverleaf section to enable traffic to merge from a right lane with intersecting traffic. The present invention eliminates weaving while eliminating two circular portions of a conventional cloverleaf.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
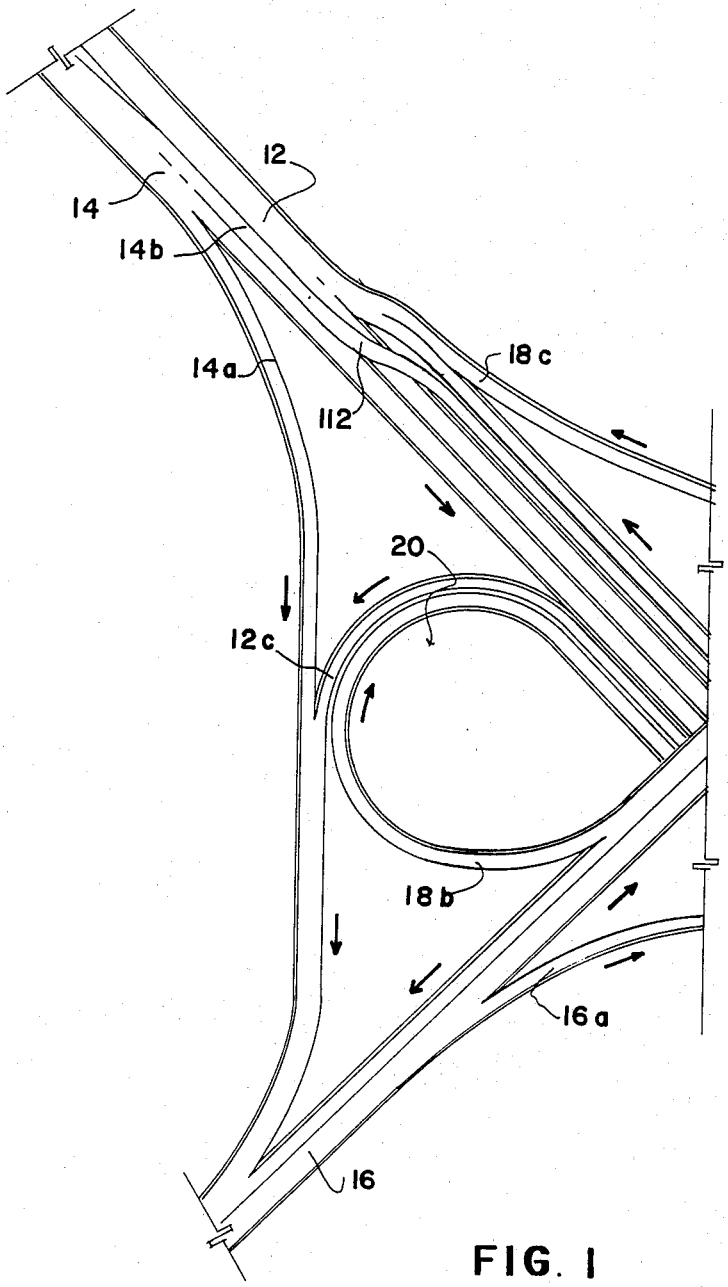
FIG. 1 is a top plan view of a section of a cloverleaf type interchange.
Figure 2:
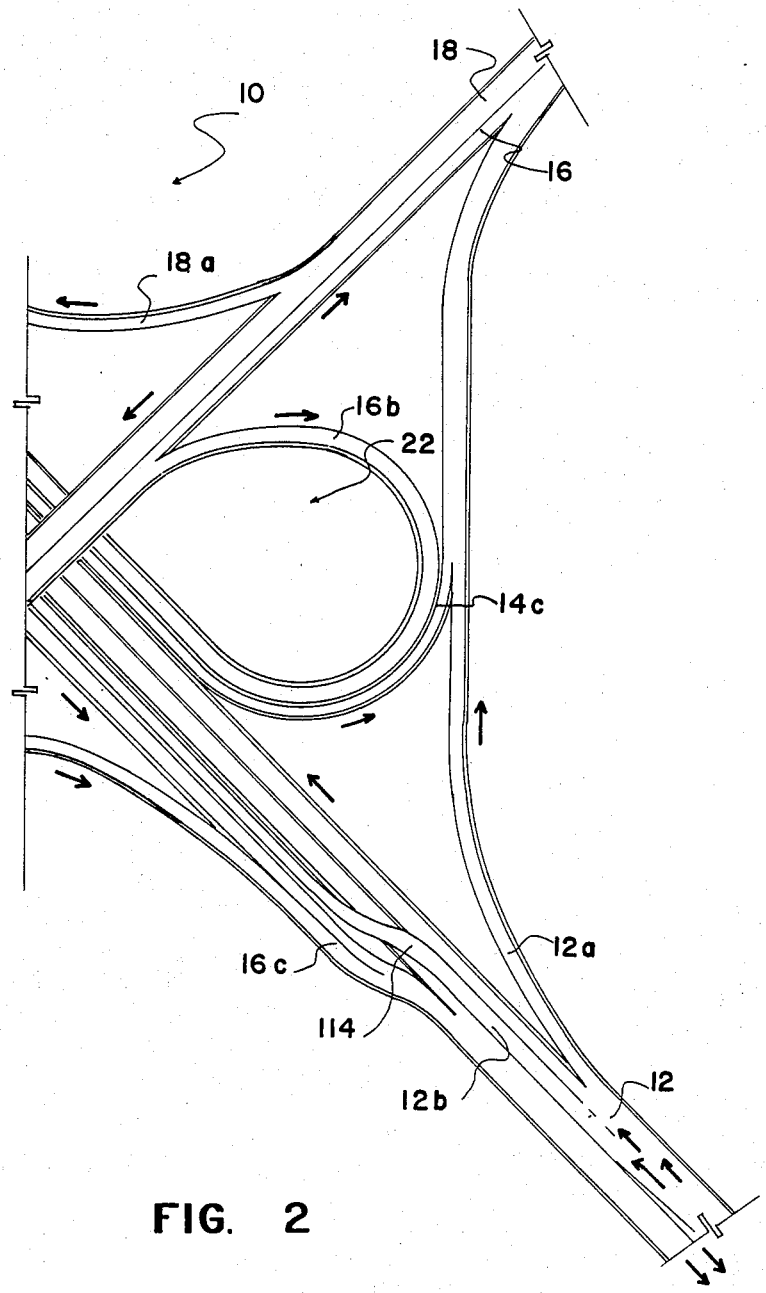
FIG. 2 is a top plan view of another section of a continuous flow cloverleaf type interchange according to the present invention.

FIGS. 1 and 2 illustrate a continuous flow cloverleaf type interchange 10. A first road surface 12 is provided for traffic traveling in a first direction. A second road surface 14 is provided for traffic traveling in a direction opposite to the first direction. A third road surface 16 is provided for traffic traveling in a direction intersecting the first and second road surfaces. A fourth road surface 18 is provided for traffic traveling in a direction opposite to traffic traveling on the third road surface 16. The first road surface 12 and the second road surface 14 intersect the third road surface 16 and the fourth road surface 18. The first and second road surfaces 12, 14 are disposed at a first elevation distinct relative to the third and fourth road surfaces 16, 18 in an area adjacent to the continuous flow interchange 10.

The continuous flow interchange 10 of the present invention is designed to eliminate weaving of traffic as the traffic enters the continuous flow interchange 10.

A first road surface right turn lane **12*a* is provided at a point displaced a predetermined distance from the continuous flow interchange 10. Traffic traveling along the first road surface 12 is enabled to complete a right-hand turn by traveling along the first road surface right turn lane 12*a* to merge with traffic traveling along the third road surface 16. A first road surface left turn lane 12*b* is provided for diverting traffic from the first road surface 12 to cross the second road surface 14 and to continue traveling in a direction opposite to the second road surface 14 in an area displaced laterally from the first road surface 12. A bridge 114 is provided to enable traffic traveling along the first road surface left turn lane 12*b* to cross over the second road surface 14**.

In another embodiment of the present invention, the first road surface left turn lane **12*b* may be directed to travel below the second road surface 14 to be directed to the area displaced laterally from the first road surface 12 and traveling in a direction opposite to the second road surface 14**.

At least a first cloverleaf section 20 is provided to enable traffic traveling along the first road surface left turn lane **12*b* to complete a left-hand turn and to merge with traffic traveling along a second road surface right turn lane 14*a*. Thereafter, the merged traffic will continue to a point adjacent the fourth road surface 18 to enable the traffic to merge with traffic on the fourth road surface 18. Traffic traveling along the first road surface left turn lane 12*b* will merge with traffic traveling along the second road surface right turn lane 14*a* in an area 12*c*** without weaving. In other words, traffic traveling along the two lanes will be merged together and the traffic will not have to weave as is required in a conventional cloverleaf interchange. Weaving exists in an area of a conventional cloverleaf interchange wherein traffic traveling along a first road surface encounters difficulty in the area immediately adjacent the interchange with slower moving traffic merging onto the road surface from one of the cloverleafs. In other words, as traffic on a first road surface desires to exit from a first road surface to another road surface, the traffic must weave in with traffic arriving onto the first road surface from another section of the cloverleaf. This weaving phenomena is extremely dangerous and should be avoided.

A second road surface left turn lane 14b is provided at a point displaced a predetermined distance from the continuous flow interchange 10. The second road surface left turn lane 14b directs traffic from a left-hand side of the second road surface 14. Traffic traveling along the second road surface left turn lane 14b is directed over a bridge 112 to cross over the first road surface 12 and to continue traveling in a direction opposite to the first road surface 12 in an area displaced laterally from the second road surface 14. Traffic traveling along the second road surface left turn lane 14b continues to an area adjacent a second cloverleaf section 22. Thereafter, the traffic enters onto a road section 14c to merge with traffic in the first road surface right turn lane 12a without weaving.

A third road surface right turn lane 16a is provided to divert traffic from the third road surface 16 onto to the second road surface 14. A third road surface left turn lane 16b diverts traffic from a right-hand side of the third road surface 16 through the second cloverleaf type section 22 to enable traffic to merge with traffic traveling along a first road surface 12.

A fourth road surface right turn lane 18a is provided to enable traffic traveling along the fourth road surface 18 to merge with traffic traveling along the first road surface 12. A fourth road surface left turn lane 18b is provided to direct traffic traveling along the fourth road surface 18 through a first cloverleaf type section 20 to enable traffic to merge with traffic traveling along the second road surface 14.

The third road surface right turn lane 16a includes a section 16c which enables traffic traveling along the third road surface right turn lane 16a to merge together with traffic traveling along the fourth road surface left turn lane 18b without weaving. In other words, traffic traveling along the third road surface right turn lane 16a and the fourth road surface left turn lane 18b can merge relative to each other and subsequently merge with traffic traveling along the second road surface 14 without weaving between the traffic. All traffic will be traveling along in the same direction to enable merger without weaving.

Similarly, the fourth road surface right turn lane 18a includes a section 18c to enable traffic traveling along the fourth road surface left turn lane 18a to merge with traffic traveling along the third road surface left turn lane 16b without weaving. Subsequently, traffic traveling along the fourth road surface right turn lane 18a and the third road surface left turn lane 16b will merge with traffic traveling along the first road surface 12 without any weaving between the traffic.

As indicated hereinabove, a conventional cloverleaf section requires weaving between traffic traveling along intersecting road surfaces. Weaving is a phenomena which should be avoided to increase traffic flow and to avoid accidents. The present invention eliminates weaving by diverting left turn traffic from a first road surface 12 and a second road surface 14 to cross over the second road surface 14 and the first road surface 12, respectively, at a point displaced a predetermined distance from the continuous flow interchange 10. In this manner, weaving between intersecting lanes of traffic at a conventional cloverleaf type interchange is avoided.

The present invention also provides improved efficiency in eliminating two of the conventional cloverleaf type sections of a four-leaf cloverleaf. More specifically, a conventional four-leaf cloverleaf interchange requires four cloverleaf type sections to enable traffic to continuously flow through the interchange. The present invention eliminates the requirement of two of the cloverleaf sections of a conventional four-leaf cloverleaf interchange.

Figure 3:
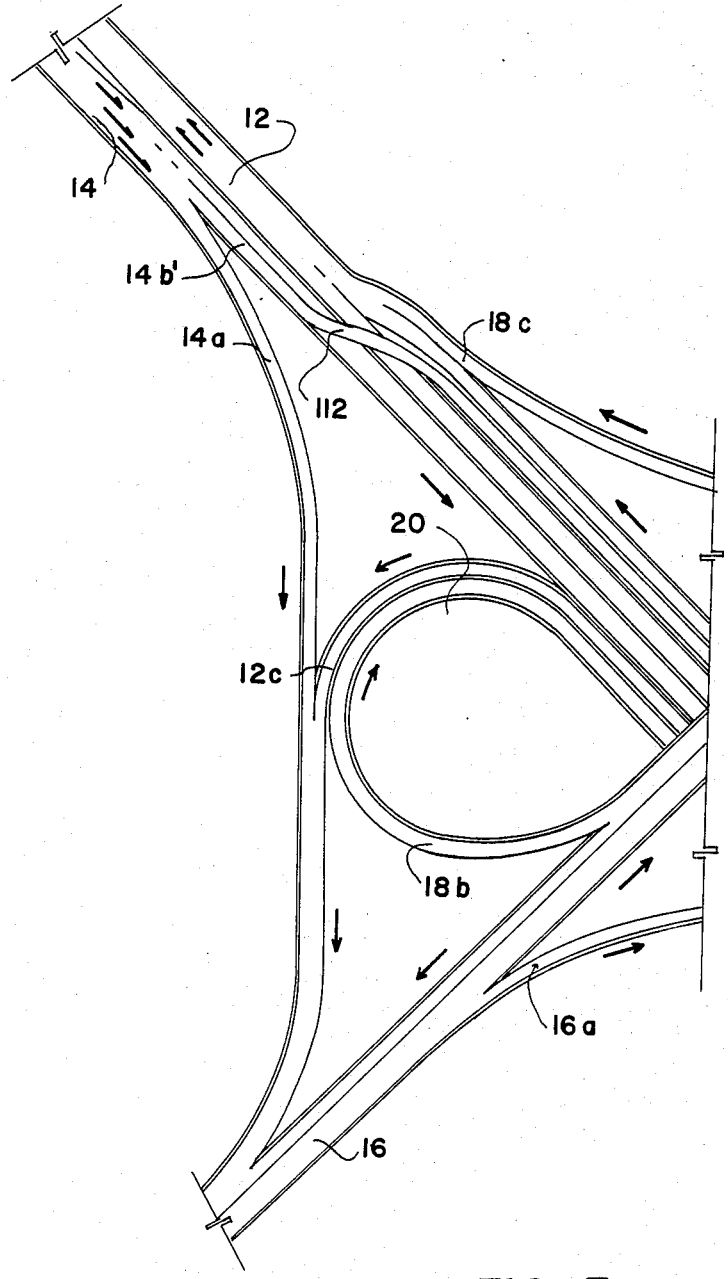
FIG. 3 is a top plan view of a second embodiment of a continuous flow cloverleaf type interchange.
Figure 4:
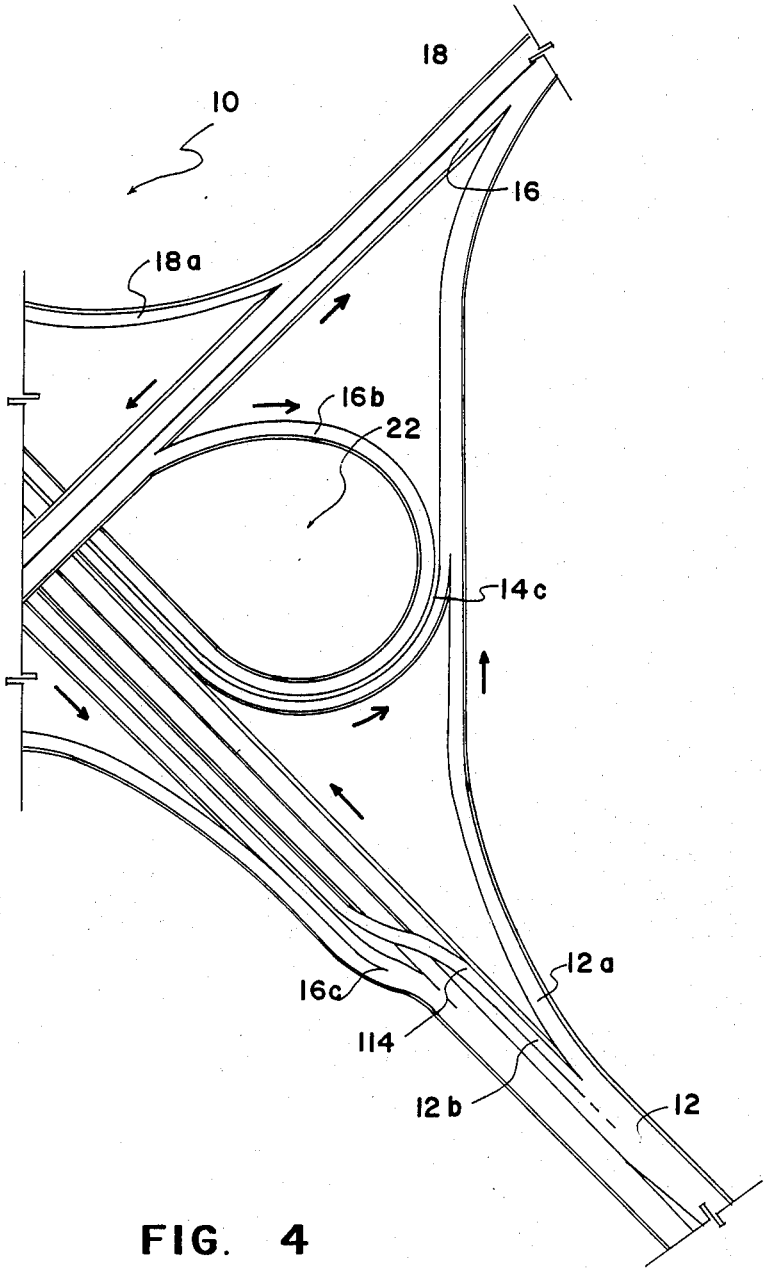
FIG. 4 is a top plan view of another section of a continuous flow cloverleaf type interchange according to the second embodiment of the present invention.

FIGS. 3 and 4 illustrate another embodiment of the present invention. In this embodiment, a first rod surface left turn lane 12b' diverts traffic from a right-hand side of the first road surface 12 to cross over the second road surface 14. Thereafter, the arrangement of the road surfaces are similar to the arrangement as set forth in FIGS. 1 and 2.

In addition, a second road surface left turn lane 14b' diverts traffic from a right-hand side of the first road surface 14 to cross over the second road surface 12. Thereafter, the arrangement of the road surfaces are similar to the arrangement as set forth in FIGS. 1 and 2.

Like reference numerals in FIGS. 3 and 4 will not be further discussed. The arrangement of the road surface in the second embodiment is essentially the same as the arrangement in the embodiment illustrated in FIGS. 1 and 2 except for the diverting of the first road surface left turn lane 12b' and the second road surface left turn lane 14b' from the right-hand side of the first road surface 12 and the second road surface 14, respectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A continuous flow cloverleaf type interchange for accommodating traffic from a plurality of road surfaces comprising:

a first road surface for traffic traveling in a first direction;

a second road surface for traffic traveling in a direction opposite to said first direction;

a third road surface for traffic traveling in a direction intersecting said first and second road surfaces;

a fourth road surface for traffic traveling in a direction opposite to said traffic traveling on said third road surface;

said first and second road surfaces intersecting said third and fourth road surfaces;

said first and second road surfaces being disposed at a first elevation distinct relative to said third and fourth road surfaces in an area adjacent to an interchange;

a first road surface left turn lane forming a distinct section of and being disposed along side said first road surface, said first road surface left turn lane diverting traffic from said first road surface to cross said second road surface at a point displaced a predetermined distance from the interchange and to continue traveling in a direction opposite to said second road surface in an area displaced laterally from said first road surface without diverting thru traffic traveling along said first and second road surfaces; and at least one substantially circular clover-leaf section for diverting traffic from said fourth road surface to merge with traffic from said second road surface;

said first road surface left turn lane traverses said interchange at said first elevation distinct from said third and fourth road surfaces and enables traffic to curve along said cloverleaf section to turn left without stopping and to merge from the right with traffic traveling along said fourth road surface without weaving.

2. A continuous flow cloverleaf type interchange according to claim 1, wherein said first road surface left turn lane initially directs traffic from the left side of the first road surface prior to crossing the second road surface.

3. A continuous flow cloverleaf type interchange according to claim 1, wherein said first road surface left turn lane initially directs traffic from the right side of the first road surface prior to crossing the second road surface.

4. A continuous flow cloverleaf type interchange according to claim 1, wherein said first road surface left turn lane crosses above said second road surface at a point displaced relative to the interchange.

5. A continuous flow cloverleaf type interchange according to claim 4, wherein said first road surface left turn lane is lowered to the elevation of said first and second road surfaces prior to enabling traffic to complete a left turn through said at least one cloverleaf section to eventually merge with traffic on said fourth road surface.

6. A continuous flow cloverleaf type interchange according to claim 1, and further including a second road surface left turn forming a distinct section of and being disposed along side said second road surface, said second road surface left turn lane diverting traffic from said second road surface to cross said first road surface at a point displaced a predetermined distance from the interchange and to continue traveling in a direction opposite to said first road surface in an area displaced laterally from said second road surface without diverting thru traffic traveling along said first and second road surfaces; and a second substantially circular cloverleaf section for diverting traffic from said third road surface to merge with traffic from said first road surface;

said second road surface left turn lane traverses said interchange at said first elevation distinct from said third and fourth road surfaces and enables traffic to curve along a portion of said second cloverleaf section to turn left without stopping and to merge from the right with traffic traveling along said third road surface without weaving.

7. A continuous flow cloverleaf type interchange according to claim 5, wherein said second road surface left turn lane initially directs traffic from the left side of the second road surface prior to crossing the first road surface.

8. A continuous flow cloverleaf type interchange according to claim 5, wherein said second road surface left turn lane initially directs traffic from the right side of the second road surface prior to crossing the first road surface.

9. A continuous flow cloverleaf type interchange according to claim 6, wherein said second road surface left turn lane crosses above said first road surface at a point displaced relative to the interchange.

10. A continuous flow cloverleaf type interchange according to claim 6, wherein said second road surface left turn lane is lowered to the elevation of said first and second road surfaces prior to enabling traffic to complete a left turn through said portion of said second cloverleaf section to eventually merge with traffic on said third road surface.

11. A continuous flow cloverleaf type interchange according to claim 6, and further including a first road surface right turn lane being disposed along said first road surface at a point displaced a predetermined distance from the interchange, said first road surface right turn lane diverting traffic from said first road surface to merge with traffic traveling along said second road surface left turn lane in an area adjacent to said second cloverleaf section without weaving.

12. A continuous flow cloverleaf type interchange according to claim 1, and further including a second road surface right turn lane being disposed along said second road surface at a point displaced a predetermined distance from the interchange, said second road surface right turn lane diverting traffic from said second road surface to merge with traffic traveling along said first road surface left turn lane in an area adjacent to said at least one clove leaf section without weaving.

13. A continuous flow cloverleaf type interchange according to claim 1, wherein said first and second road surfaces are at a lower elevation relative to said third and fourth road surfaces.

* * * * *